US006230881B1

(12) United States Patent
Collura

(10) Patent No.: US 6,230,881 B1
(45) Date of Patent: May 15, 2001

(54) BOTTLE CARRIER

(76) Inventor: Peter C. Collura, 12224 Praire Dunes Rd., Baynton Beach, FL (US) 33437

( * ) Notice: Subject to any disclaimer, the term of this patent is extended or adjusted under 35 U.S.C. 154(b) by 0 days.

(21) Appl. No.: 09/544,211

(22) Filed: Apr. 7, 2000

Related U.S. Application Data

(60) Provisional application No. 60/128,618, filed on Apr. 9, 1999.

(51) Int. Cl.[7] ..... B65D 75/00

(52) U.S. Cl. ..... 206/175; 206/180; 206/198

(58) Field of Search ..... 206/162, 167, 206/170, 174–178, 180, 181, 188, 193, 198, 200; 229/117.12

(56) References Cited

U.S. PATENT DOCUMENTS

| | | | | |
|---|---|---|---|---|
| 4,469,222 | * | 9/1984 | Graser | 206/180 |
| 4,770,294 | * | 9/1988 | Graser | 206/180 |
| 5,680,930 | * | 10/1997 | Stone | 206/180 |
| 5,941,377 | * | 8/1999 | Hart et al. | 206/175 |
| 5,947,273 | * | 9/1999 | Dalrymple et la. | 206/178 |
| 6,131,729 | * | 10/2000 | Eckermann et al. | 206/178 |

* cited by examiner

*Primary Examiner*—Luan K. Bui
(74) *Attorney, Agent, or Firm*—Rodger H. Flagg

(57) ABSTRACT

A bottle carrier is foldable from two blanks, and is relatively strong, inexpensive to manufacture, aesthetic in appearance, and easy to assemble. The carrier has several advantages: it provides a reduction in paper board costs, improves manufacturing costs, retains the "basket" features demanded by the marketing needs of the beverage industry, and improves packaging line production at the beverage manufacturing location. The carrier is made by joining two blanks, one of which is a component referred to as a shell. The shell provides all "basket" printed surfaces and a handle visible to the consumer on the display shelf. The second component provides the internal longitudinal and transverse product separation, handle reinforcement, and bottom closure flaps. This component is referred to as a partition assembly. The shell and the partition assembly are formed as die cut components, which are then accurately joined by adhesive applied to designated locations. The two blanks are then further folded and glued to form a collapsed "basket". The collapsed "basket" is then delivered to the beverage or glass manufacturing location. The "basket" is then erected, bottom flaps are folded and locked or adhesively secured, and thus is ready for filling with product. The "basket" can be filled either on or off a bottling line. This combination carrier and handle apparatus may also be inserted over the bottles with the bottom open, and then subsequently sealed.

20 Claims, 8 Drawing Sheets

BOTTLE CARRIER

This application claims benefit of Ser. No. 60/128,618 filed Apr. 9, 1999.

FIELD OF THE INVENTION

The present invention relates to foldable blanks for forming bottle carriers, and to a process and method for assembling a bottle carrier from foldable blanks.

BACKGROUND OF THE INVENTION

Packages are known in the prior art for carrying bottles or cans. Such carriers can be formed of plastic, cardboard, or other materials. However, it is a problem in the art to provide a bottle carrier using more cost efficient material which is relatively strong, inexpensive to manufacture, aesthetic in appearance, and easy to assemble.

U.S. Pat. No. 4,327,829 to Hughes teaches a display carton and blank therefor. The assembled carton has openable ends.

U.S. Pat. No. 4,509,640 to Joyce teaches a carton with separators, a blank, and an apparatus for erecting a carton from the blank. A relatively complex blank and folding operation are shown.

U.S. Pat. No. 4,588,077 to Champlin et al. teaches a carrier handle. The carrier handle is formed by a folded blank having two holes, the two holes being in overlying relationship in the assembled carrier to form a handle portion.

U.S. Pat. No. 4,406,365 to Kulig discloses a basket type bottle carrier. The bottle carrier has an integral handle portion formed from holes in the blank used to form the carrier.

U.S. Pat. No. 5,709,298 to Harris teaches a basket-style carrier with non-collapsing end panels. The carrier is formed from a single blank, the blank having holes forming the handle portion.

U.S. Pat. No. 4,770,294 to Graser teaches a two-piece beverage carrier. The carrier is formed from two foldable blanks.

U.S. Pat. No. 4,362,240 to Elward teaches an article carrier carton. The carton is formed from a blank and can carry six bottles.

U.S. Pat. No. 4,147,290 to Stout teaches an article carrier handle structure. The handle is formed from a blank having interrupted cut lines.

U.S. Pat. No. 2,382,844 to Arneson is directed to a bottle carrier. The carrier is formed from a blank, and includes hole portions used to form a handle.

U.S. Pat. No. 2,239,564 to Lyons, Jr., is directed to a folding bottle carrying carton. The carton is formed from a blank, and has a handle.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a bottle carrier, which is relatively strong, inexpensive to manufacture, aesthetic in appearance, and easy to assemble while reducing the use of premium grade paper board.

The beverage industry markets products in a printed paper board carrier holding multiple units of glass and plastic containers. This package is commonly referred to as a "basket". The "basket" provides individual product separation minimizing product damage during the shipping and distribution cycle. Current "baskets" in use provide attractive graphics, which are multi-color printed, have a substantial carry handle, and have an open top which facilitates easy access, removal, and replacement of the product.

The basic "basket" as now commonly used has existed for several decades. Over the years there have been minor revisions to this basic "basket" for the sake of cost reduction. The "basket" has survived the marketing needs of the beverage industry by providing a consumer friendly package to the end user.

The paper board used on current "baskets" is a special custom formulated sheet. This special sheet is used to manufacture the total one-piece "basket". The sheet provides excellent white printing surface, superior tear strength, improved stiffness, and surfaces and furnish resistance to moisture absorption. The beverage and packaging industries are continually seeking a more cost effective package while retaining the consumer friendly features of the present "basket".

The carrier according to the present invention has several advantages. It provides a reduction in paper board costs. It improves manufacturing costs of the present "basket". It retains the "basket" features demanded by the marketing needs of the beverage industry. It provides continuous seamless printed display surfaces; and, it improves packaging line production at the beverage manufacturing location.

More specifically, the carrier according to the present invention is made by joining two blanks made from similar or different grades of paper board. One component is referred to herein as the shell. The shell provides all "basket" printed surfaces including a handle, visible to the consumer on the display shelf. The shell can be made from a white coated paper board or other material combination providing an adequate printing surface.

The second component representing a substantial portion of the total combined paper board area provides the internal longitudinal and transverse product separation, handle reinforcement, and bottom closure flaps. This component is referred to herein as a partition assembly. The partition assembly does not require printing, since it is not readily visible to the consumer when filled with articles to be carried and displayed.

The two blanks, namely the shell and the partition assembly, are preferably formed as die cut components, which are then accurately joined by adhesive applied to designated locations. The two blanks are then further folded and glued to form a collapsed "basket". The collapsed "basket" is then delivered to the beverage or glass manufacturing location. The "basket" is then erected, bottom flaps are folded and can be either locked or adhesively secured, and thus is ready for filling with product. The "basket" can be filled either on or off a bottling line.

Other objects and advantages of the present invention will be more readily apparent from the following detailed description when read in conjunction with the accompanying drawings.

DETAILED DESCRIPTION OF THE INVENTION

Figure 1A:
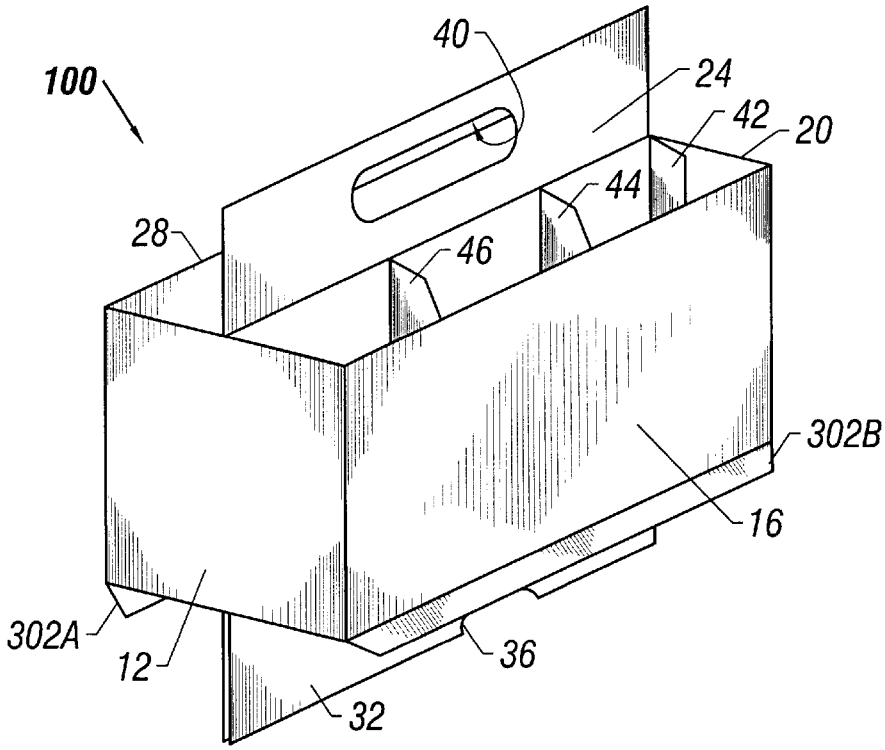
FIGS. 1A and 1B are perspective views of an erected basket assembly, prior to securing the bottom portion of the basket, according to the present invention.

FIG. 1A is a perspective view of an erected bottle carrier apparatus 100, prior to securing the bottom portion of the basket together. In this view, a top portion 24 includes a handle 40, and a bottom flap portion 32 is visible having a notch or cutout region 36. The bottle carrier apparatus 100 has opposed sidewalls 16 and 28, and connecting opposed sidewalls 12 and 20. Partition members 44 and 46 are visible in this view, as is a folded connecting extension 42, which is adhered to the wall 20.

Figure 1B:
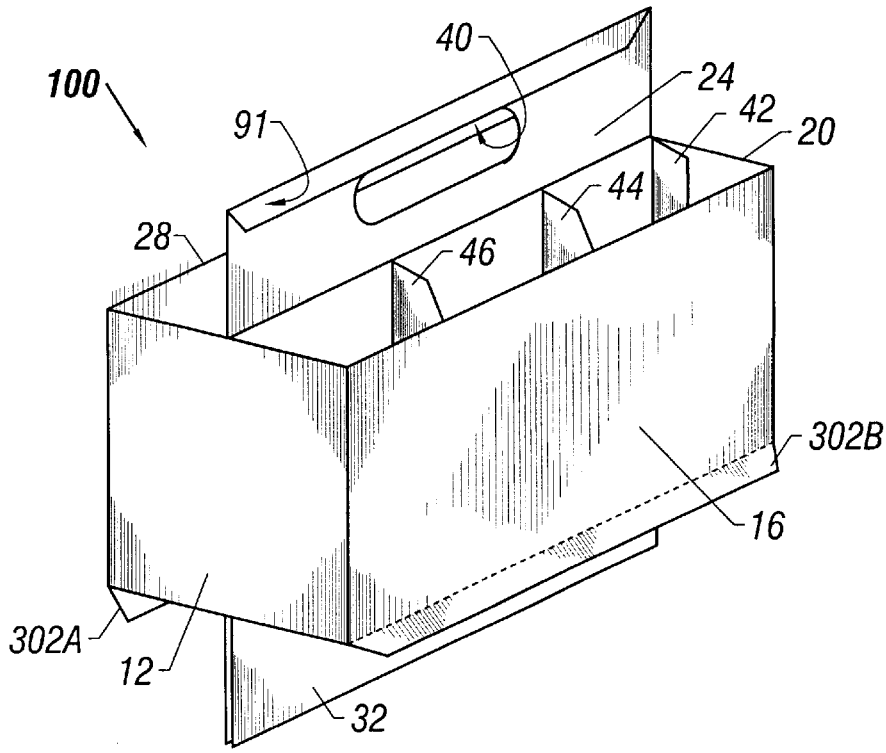

FIG. 1B is a perspective view of an alternate embodiment of an erected bottle carrier 100 shown in FIG. 1A, having an alternate handle 40 configuration.

Figure 2A:
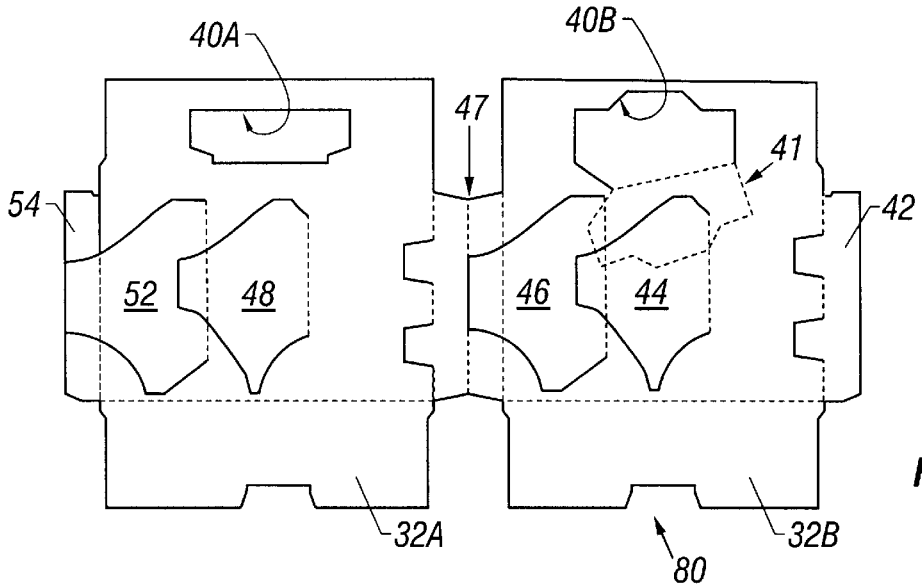
FIG. 2A is an elevational view of a blank for a partition assembly used to form the carrier of FIG. 1A. Note the handle configuration.

FIG. 2A is an elevational view of a blank 80 of a partition assembly, used to form the carrier 100 of FIG. 1A. The partition assembly blank 80 includes holes 40A and 40B used to form the handle 40 when the partition assembly blank 80 is folded on crease line 47. A plurality of partitions 44, 46, 48 and 52 (also referred to herein as contour partitions) are formed in the partition assembly blank 80 as shown by the solid lines. The handle hole 40B is formed by folding over a flap 41 which is shown in dashed outline in FIG. 2. The folded connecting extension 42 is seen in FIG. 2A along with an opposite folded connecting extension 54 serving the same purpose. The bottom flap portion 32 is formed by the bottom flap portions 32A and 32B of FIG. 2A, which together are used to form a bottom closure in a finished bottle carrier apparatus 100.

Figure 2B:
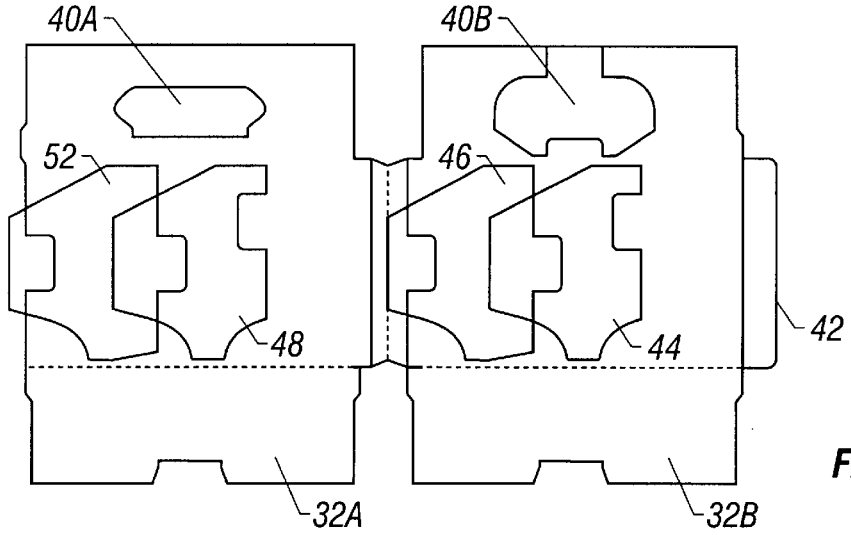
FIG. 2B is an alternate view of a blank for a partition assembly used to form the carrier of FIG. 1A. Note the alternate handle configuration.

FIG. 2B is an elevational view of a blank for a partition assembly, as shown in FIG. 2A, showing a nested handle 40 configuration, including a take-up feature.

Figure 2C:
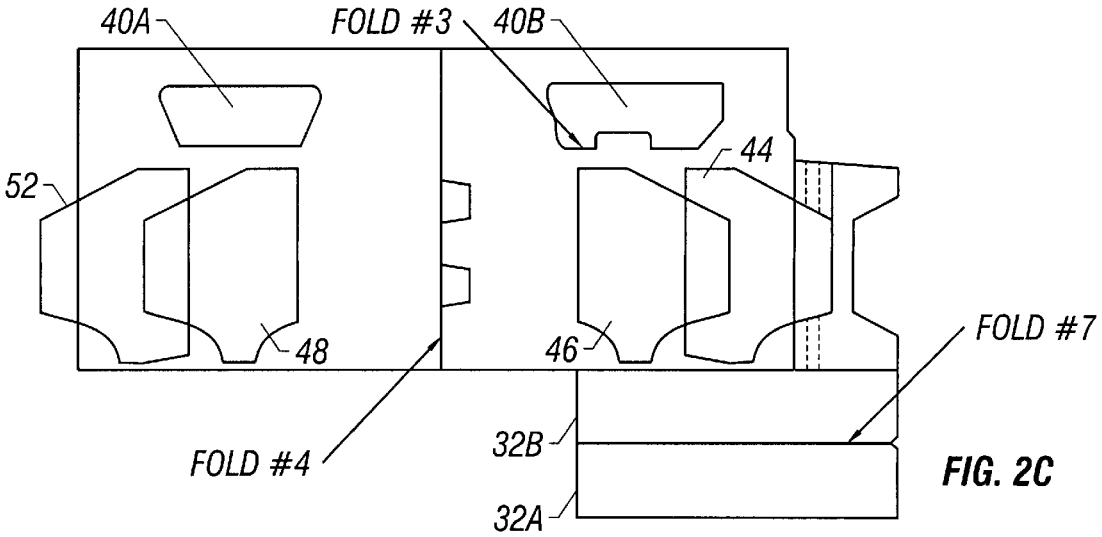
FIG. 2C is another embodiment of a blank for a partition assembly used to form the carrier of FIG. 1A. Note the alternate handle configuration, and the alternate bottom portion.
Figure 3A:
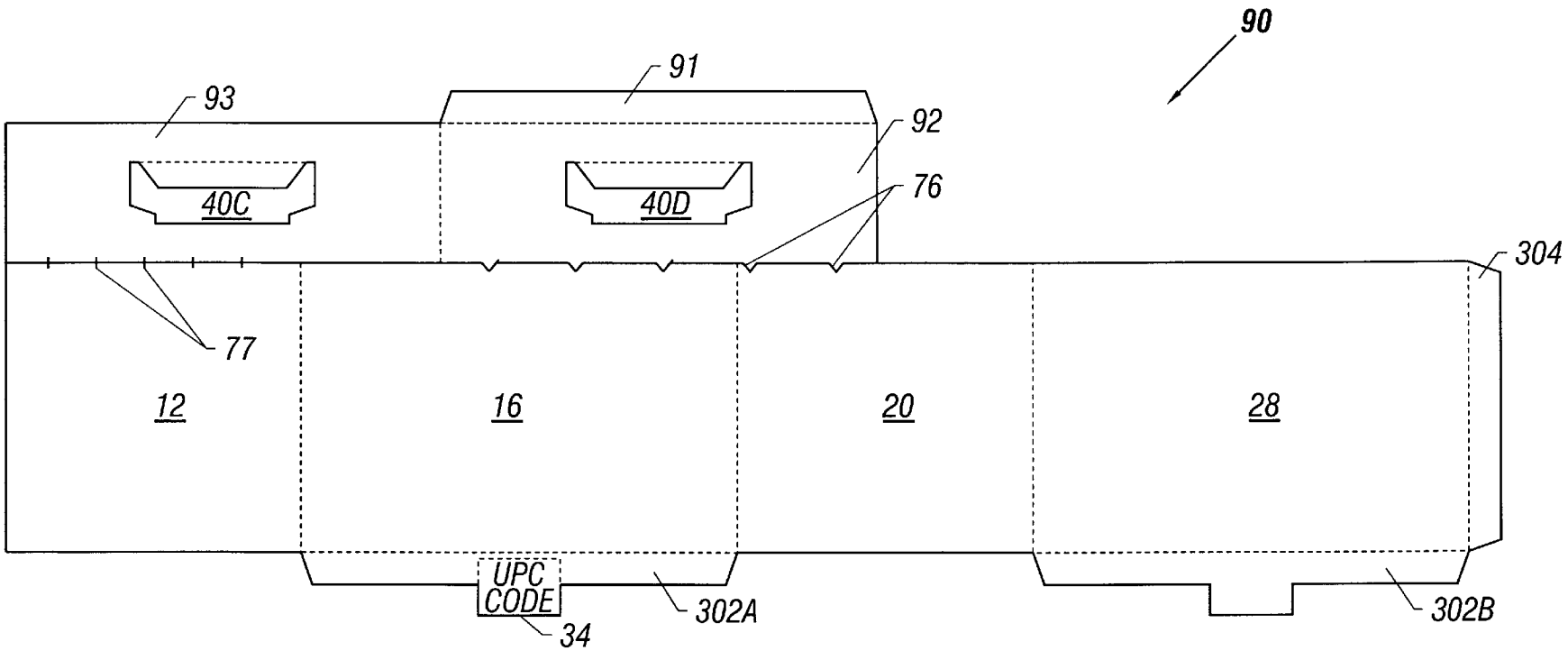
FIG. 3A is an elevational view of a partition assembly. Note the nicks used to provide a progressive tear portion, and the UPC code location.

FIG. 2C is an elevation view of a blank for a partition assembly, showing fold lines and a two part bottom portion FIG. 3A is an elevational view of a shell blank 90 which is used together with the partition assembly blank 80 of FIG. 2 to form the carrier 100 of FIG. 1A. The shell blank 90 provides all "basket" printed panels and a handle 40 formed from portions 92, 93 which is visible to the consumer when the carrier is on a display shelf. The shell blank 90 can be made from a white coated paper board or other material combination providing an adequate printing surface.

As seen in FIG. 3A, the shell blank 90 includes the top portion 91, the handle 40, and the bottom flap portion 302. As seen in this view, the bottle carrier 100 includes opposed sidewalls 16 and 28 and the connecting opposed sidewalls 12 and 20. A reverse partial cut 76 is shown in this view, providing a soft nick release to permit ready separation during the final assembly process. Additional flaps 302 and 304 are provided for assembly.

The soft nick release feature is an important feature of the present invention, and is considered to be an advance over the prior art. Nicks are required to hold sections 93-92 together with 12-16-20 following die cutting of blanks and during the folding and gluing process. These two sections are connected to 12-16-20 and then separated when the basket is erected. Nicks on section 93 (FIG. 3A) are accessible during folding and gluing processes and are mechanically broken at that time. Nicks on section 92 (FIG. 3A) are not accessible for mechanical separation. Thus the need for soft, controlled separation during erection of the "basket". The diagonal partial cuts shown on either side of the nicks in FIG. 3A are partially cut on the reverse side of the blank during the die cutting process. This reverse cutting, in conjunction with a normal uncut nick, provides soft separation and controlled tracking when the "basket" is erected.

Figure 3B:
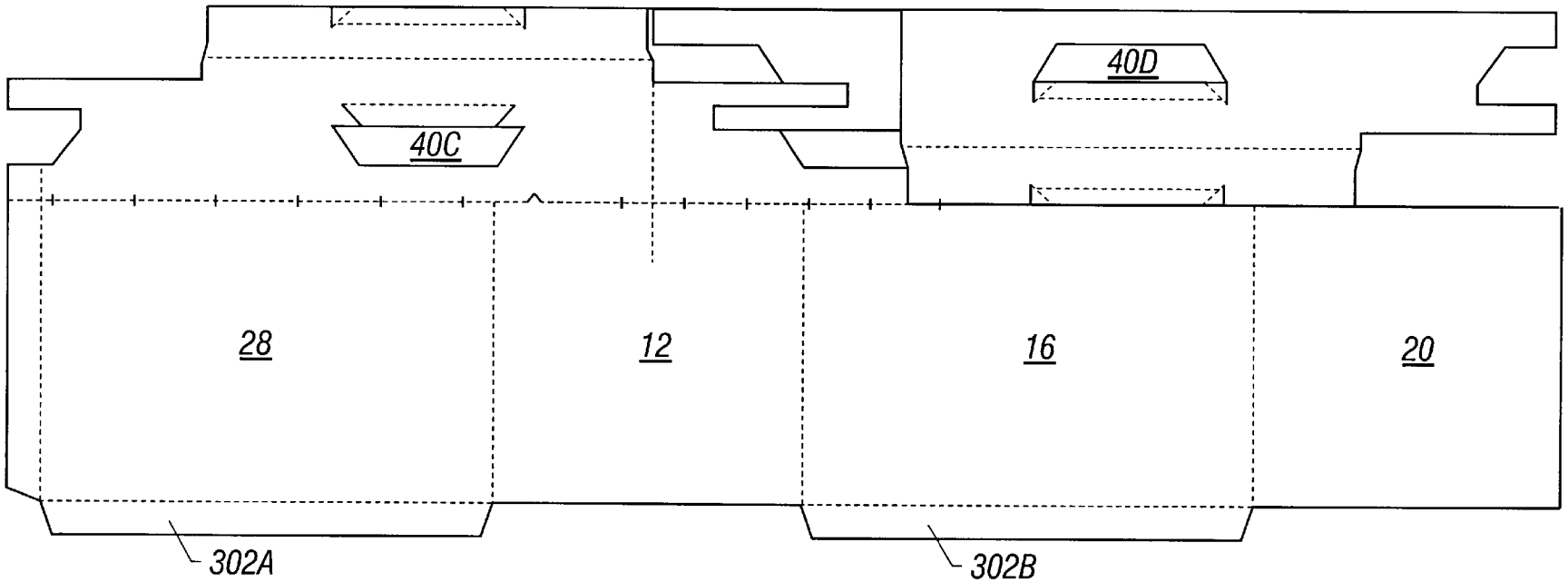
FIG. 3B is an alternate view of a partition assembly, showing an alternate handle configuration.

Note zipper feature 77 in FIG. 3A and FIG. 3B, which is a series of cuts with a short diagonal configuration at one end and separated by a nick. The diagonal cut intercepts the nick tear line during progressive opening of the basket and provides a controlled tear line there-between.

The eventual complete separation of 93-92 from 12-16-20 is accomplished with the cooperation of element 80 of FIG. 2A working together with element 90 of FIG. 3A.

FIG. 3B is an alternate view of FIG. 3A, wherein a blank is used for a shell together with a partition assembly of FIG. 2B to form the carrier of this inveniton. Note the alternate handle 40C and 40D, and bottom portions 302A and 302B.

Figure 3C:
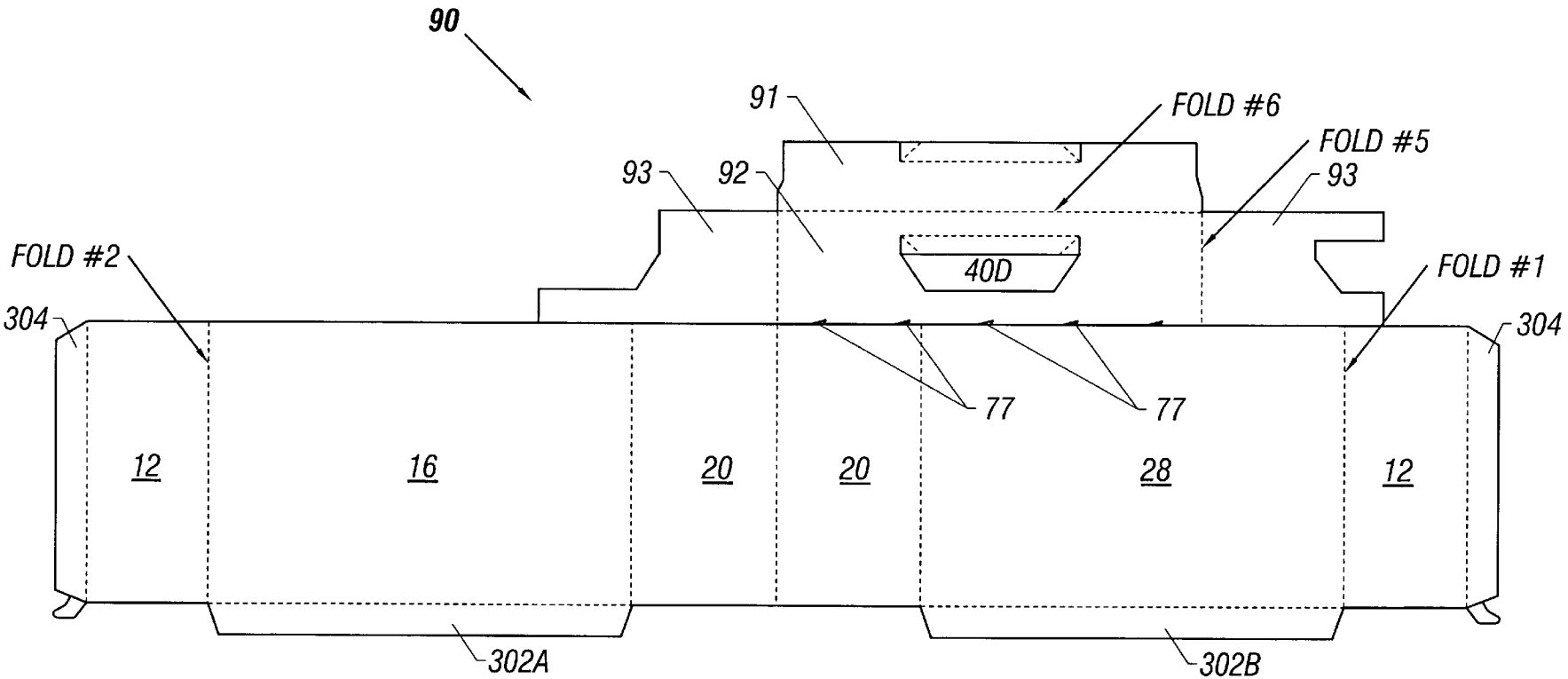
FIG. 3C is another view of a partition assembly, showing an alternate handle configuration, with recommended fold lines.

FIG. 3C is an alternate view of FIG. 3B, showing a modified handle portion, together with recommended fold lines.

The well known Universal Product Code (UPC) symbols are indicated at element 34 of FIG. 3. Since element 80 of the present invention advantageously does not require printing, the cut out provides access to the UPC by printing it on element 90 (as shown in FIG. 3A). This is significant in that it has not been heretofore possible to have an all brown bottom basket prior to the present invention. All currently used baskets now print the UPC on the bottom panel.

Figure 4A:
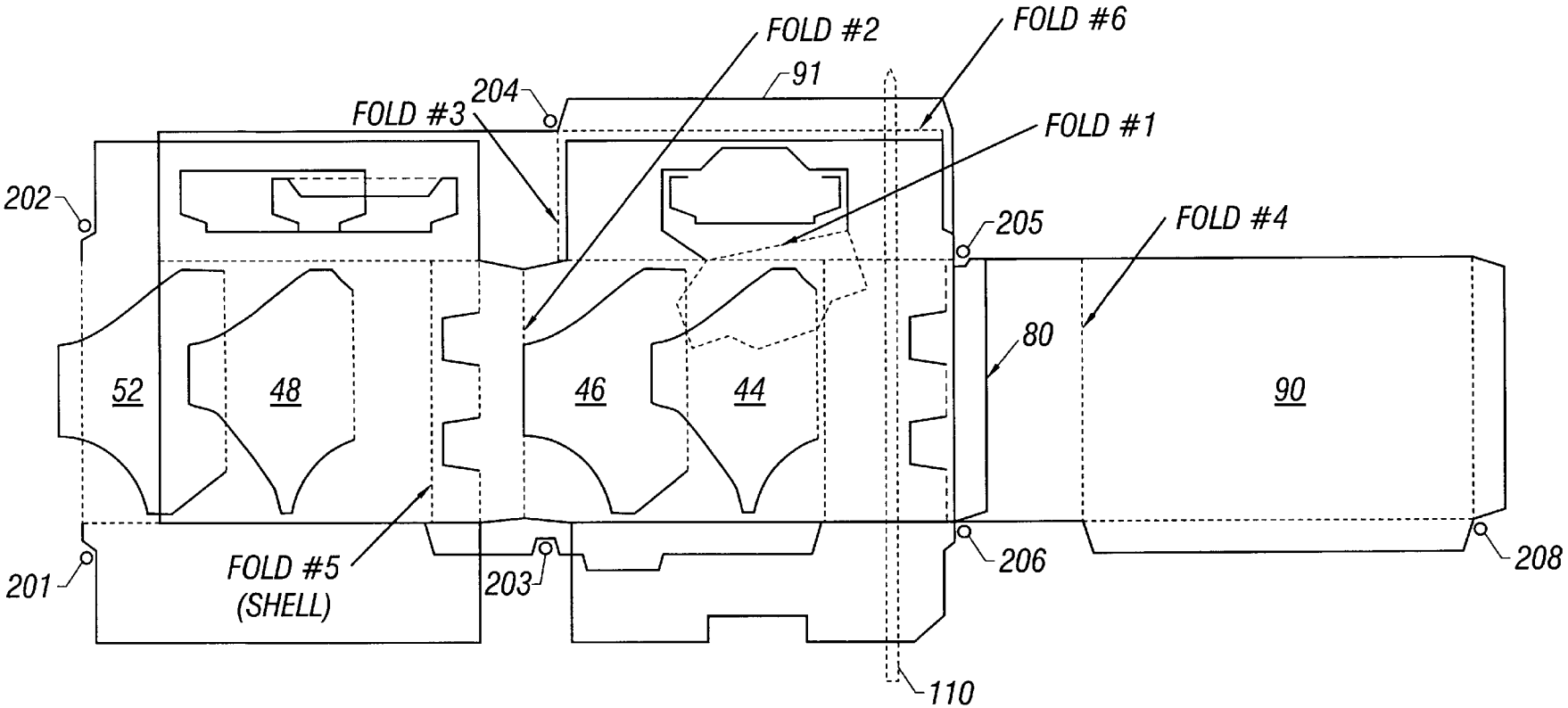
FIG. 4A is a schematic overlay view of the shell of FIG. 2A superimposed with the partition assembly of FIG. 3A. Note the recommended fold lines and pin locations for precisely aligning the shell with the partition assembly.

FIG. 4A is a schematic overlay view of the shell blank 90 of FIG. 3A superposed with the partition assembly blank 80 of FIG. 2A with alignment points 201, 202, 203, 204, 205, 206, and 208 being provided to obtain an accurate alignment of the partition assembly blank 80 and the shell blank 90. The alignment points 201, 202, 203, 204, 205, 206, and 208 are preferably aligned using pins. An arrow 110 is shown in this view to indicate the direction in which the blank will be inserted into a folding machine (not shown).

The two blanks, namely the shell blank 90 and the partition assembly blank 80, are preferably formed as die cut components, which are then accurately joined by adhesive applied to designated locations. Such locations can be selected by any one having skill in the carrier assembly arts, to permit folding to form the final carrier product. The two blanks are then further folded and glued to form a collapsed "basket". The collapsed "basket" is then delivered to the beverage or glass manufacturing location. The "basket" is then erected, bottom flaps are folded and locked or adhesively secured, and thus is ready for filling with product. The "basket" can be filled either on or off a bottling line.

FIG. 4A shows the recommended folding sequence of the indicated folds, labeled as Folds 1 through 6 in this drawing. Note the location of alignment pins 201 through 206. The alignment pins are located adjacent to slots to align the shell assembly and the partition assembly 80 to form the collapsed basket prior to folding. FIG. 4A also shows the preferred machine direction 110. Note the location of the bottom flaps 32A and 32B, with the cutout 33 positioned in bottom flap 32B.

Figure 4B:
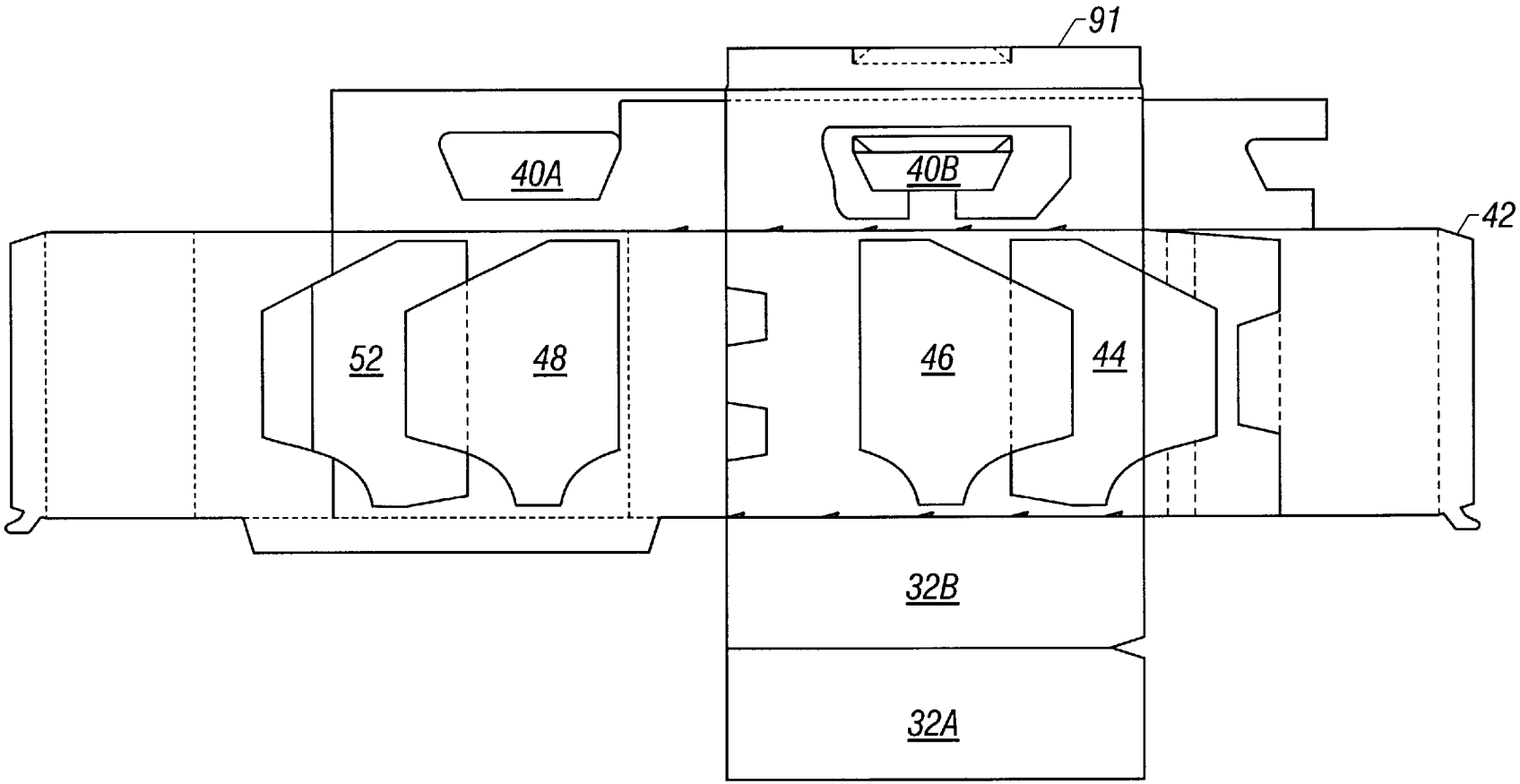
FIG. 4B is an alternate embodiment of the schematic overlay view of the shell of FIG. 2C with the partition assembly of FIG. 3C.

FIG. 4B is an alternate configuration, showing the shell blank 90 of FIG. 3C superimposed with the partition assembly blank of FIG. 2C. Note the alternate handle 40A and handle 40B configuration shown in FIG. 3C, as well as the bottom configuration shown in FIG. 2C.

Figure 5:
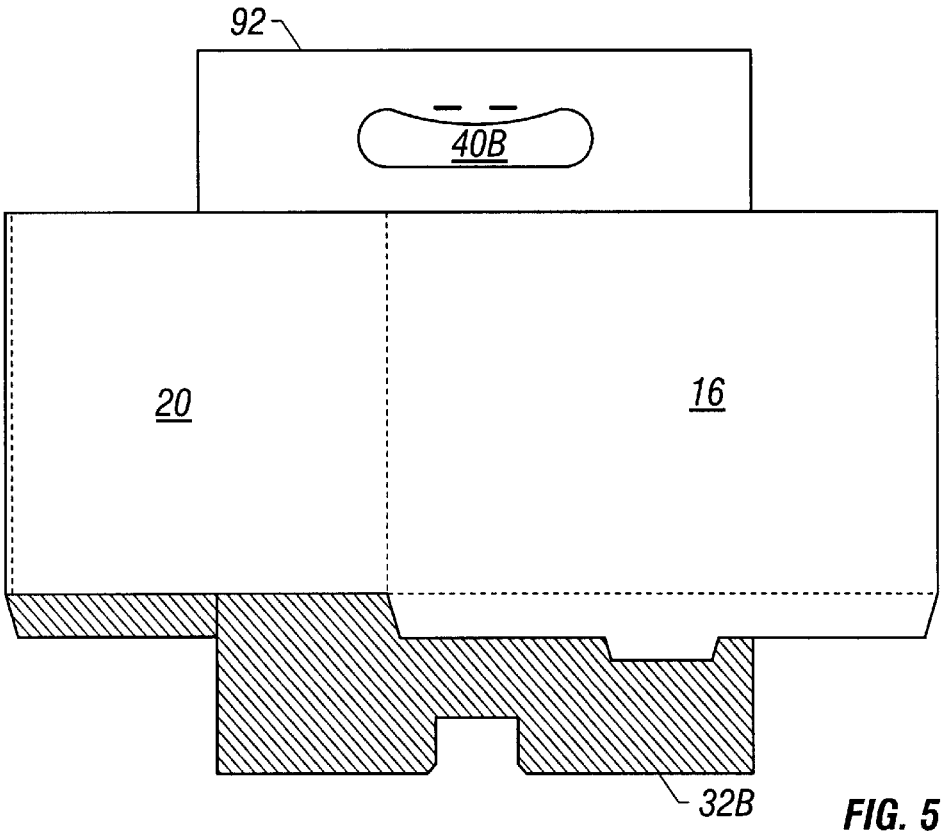
FIG. 5 is an elevational view of the bottle carrier in a folded condition, showing a notch in the lower portion of one side of the bottom portion of the basket.

FIG. 5 is an elevational view of the bottle carrier 100 of FIG. 1 in a folded collapsed condition, according to the present invention, showing side 20 and side 16 in the foreground, and shaded side 12 and side 28 shown behind sides 20 and 16. Note the cutout 33 in flap 32B shown shaded in FIG. 5.

Figure 6:
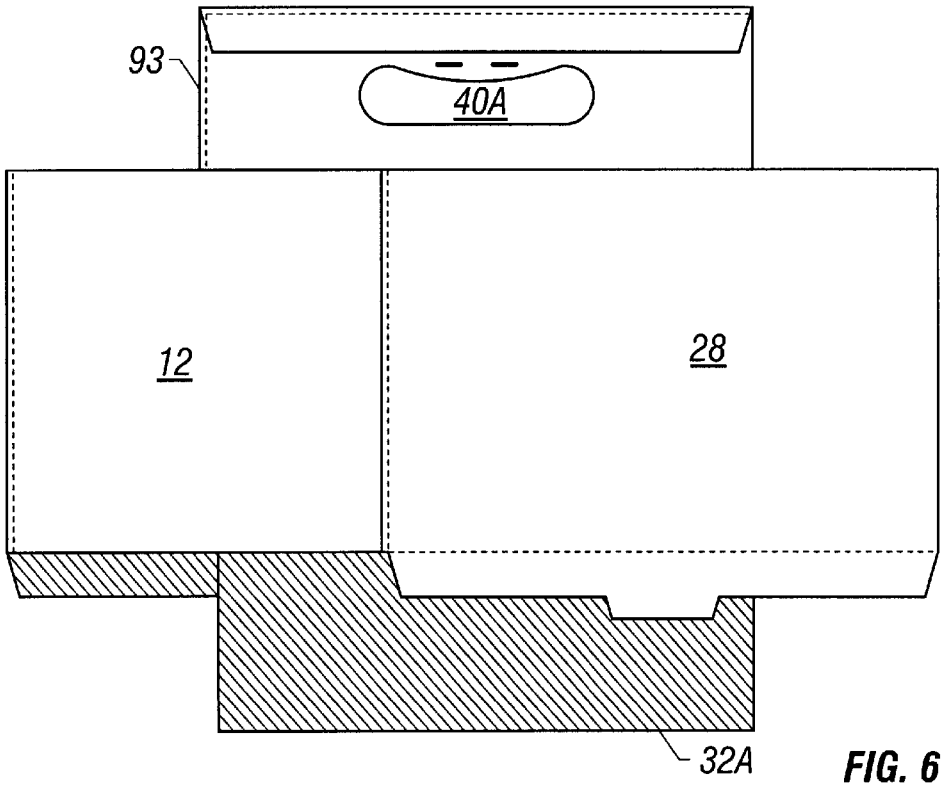
FIG. 6 is an elevational view of the opposite side of the bottle carrier of FIG. 5, without the notch in the lower portion of the other side of the bottom portion of the basket.

FIG. 6 is an elevational view of the opposite side of the bottle carrier 100 of FIG. 5 in a folded collapsed condition, according to the present invention, showing side 12 and side 28 in the foreground, with the lower flap 32A of the partition assembly shown shaded in FIG. 6.

The bottle carrier 100 disclosed herein, may be erected as shown in FIG. 1A or FIG. 2B, with existing basket erecting machines located an many user facilities. The bottom portions may then be sealed prior to the insertion of the bottles, cans or other containers into the bottle carrier 100. Alternately, the bottle carrier 100 disclosed herein may be erected as previously noted, and the baskets dropped over the top of bottles, cans or other containers, and followed by closing and sealing the bottom portions.

FIG. 3C discloses the means to complete the folding and gluing of the basket bottom in a collapsed deliverable mode, while still offering the advantages of selecting cost effective grades and thicknesses of paperboard for each component part of the carrier basket disclosed herein.

The footprint of the shell and partition shown in FIG. 3C offers economical nested sheet and web layouts. The erecting geometry requires separation of the bottom panel from the partition assembly, so that the bottom panel may be adhesively integrated to the shell bottom through the use of break away nicks. In this embodiment, fold #1 locates and stabilizes the partition edge against the crease line. Fold #4 folds the shell and partition simultaneously, insuring the final horizontal position between the shell and the partition. Fold #6 assists in the vertical orientation of the shell and the partition, to produce the preferred basket assembly.

The invention being thus described, it will be evident that the same may be varied in many ways. Such variations are not to be regarded as a departure from the spirit and scope of the invention and all such modifications are intended to be included within the scope of the claims.

I claim:

1. A combination carrier and handle apparatus for accommodating a plurality of articles arranged in a pair of substantially parallel co-extensive rows, which comprises:

a) a partition assembly blank, having foldable, internal longitudinal and transverse product separation panels, handle reinforcement panels, and bottom closure flaps;

b) a shell blank having four foldable side panels joined to two raised handle panels, and at least one of the side panels having a side closure flap and at least one bottom closure flap, said shell blank pre-printed with indicia prior to assembly;

c) a collapsed basket formed of the partition blank and the shell blank, which are aligned and adhesively secured together at designated locations to permit further folding, the collapsed basket pre-assembled in collapsed form for ease of shipping, handling and storage prior to use as a combination carrier and handle apparatus; and wherein the collapsed basket are folded into the combination carrier and handle apparatus with the bottom flaps folded and glued together.

2. The combination carrier and handle apparatus of claim 1, wherein the shell blank and the partition blank are each die cut.

3. The combination carrier and handle apparatus of claim 1, wherein the handle portion includes a handle flap which is folded over opposing handle sides and glued to the handle portion for added strength at assembly.

4. The combination carrier and handle apparatus of claim 2, wherein the fold lines are stamped during the die cut operation for ease of folding.

5. The combination carrier and handle apparatus of claim 1, wherein the bottom flaps on the collapsed basket are folded and latched together at assembly to form the combination carrier and handle apparatus.

6. The combination carrier and handle apparatus of claim 1, wherein the shell blank is made of white coated paper suitable for printing.

7. The combination carrier and handle apparatus of claim 1, wherein reverse partial cut tabs are provided in spaced relation to provide a soft nick release between the shell blank side panels and the handle panels.

8. The combination carrier and handle apparatus of claim 1, wherein the shell blank side panels and the partition panels are aligned with a plurality of pins positioned in relation to slots and tabs located on the shell blank panels and the partition panels.

9. The combination carrier and handle apparatus of claim 1, wherein a UPC printed code is marked on at least one bottom flap extending from the shell blank.

10. A combination carrier and handle apparatus for accommodating a plurality of articles arranged in a pair of substantially parallel co-extensive rows, which comprises:

a) partition blank, having foldable, internal longitudinal and transverse product separation panels, handle reinforcement panels, and bottom closure flaps;

b) a shell blank having four foldable side panels joined to two raised handle panels, with reverse partial cut tabs aligned in spaced relation to provide a soft nick release between the shell blank side panels and the handle panels, said shell blank pre-printed with indicia prior to assembly;

c) a collapsed basket assembly formed of the partition blank and the shell blank, which are aligned and adhesively secured together at designated locations to permit further folding, the collapsed basket pre-assembled in collapsed form for ease of shipping, handling and storage prior to use as a combination carrier and handle apparatus; and d) a zipper formed by a plurality of short diagonal cuts separated by a nick which intercepts a nick tear line during progressive opening of the basket to provide a controlled tear line.

11. The combination carrier and handle apparatus of claim 10, wherein the shell blank and the partition blank are each die cut prior to assembly into the collapsed basket.

12. The combination carrier and handle apparatus of claim 10, wherein the handle portion includes a handle flap which is folded over opposing handle sides and glued to the handle portion for added strength at assembly.

13. The combination carrier and handle apparatus of claim 10, wherein the fold lines are stamped during the die cut operation for ease of folding at assembly.

14. The combination carrier and handle apparatus of claim 10, wherein the bottom flaps on the collapsed basket are folded and latched together at assembly to form the combination carrier and handle apparatus.

15. The combination carrier and handle apparatus of claim 10, wherein the shell blank is made of white coated paper suitable for printing.

16. The combination carrier and handle apparatus of claim 10, wherein the shell blank side panels and the partition panels are precisely aligned with a plurality of pins positioned in relation to at least one of: slots and tabs and edges, located on the shell blank panels and the partition panels.

17. The combination carrier and handle apparatus of claim 10, wherein a UPC printed code is marked on at least one bottom flap extending from the shell blank.

18. A combination carrier and handle apparatus for accommodating a plurality of articles arranged in a pair of substantially parallel co-extensive rows, which comprises:

a) partition blank, having foldable, die cut, internal longitudinal and transverse product separation panels, handle reinforcement panels, and bottom closure flaps;

b) a shell blank having four foldable die cut side panels joined to two raised handle panels and two bottom flaps, with reverse partial cut tabs aligned in spaced relation to provide a soft nick release between the shell blank side panels and the handle panels, said shell blank pre-printed with indicia prior to assembly, the indicia including a UPC code located on at least one bottom flap;

c) a collapsed basket formed of the partition blank and the shell blank, which are aligned and adhesively secured together at designated locations to permit further folding, the collapsed basket pre-assembled in collapsed form for ease of shipping, handling and storage prior to use as a combination carrier and handle apparatus;

d) the shell blank side panels and the partition panels are aligned with a plurality of pins positioned in relation to at least one of: slots, tabs and edges, located on the shell blank panels and the partition panels for ease of alignment;

c) a zipper formed by a plurality of short diagonal cuts separated by a nick which intercepts the nick tear line during progressive opening of the basket to provide a controlled tear line; and d) the collapsed basket is folded into the combination carrier and handle apparatus with the bottom flaps folded and glued together.

19. The combination carrier and handle apparatus of claim 18, wherein the handle portion includes a handle flap which is folded over opposing handle sides and glued to the handle portion for added strength.

20. The combination carrier and handle apparatus of claim 18, wherein a first handle portion includes opposing, adjacent partial handle portions, which are folded over the first handle portion to form a five thickness handle portion.

* * * * *